US005325937A

United States Patent [19]

Suchodolski et al.

[11] Patent Number: 5,325,937

[45] Date of Patent: Jul. 5, 1994

[54] ELEVATOR PLATFORM ISOLATION

[75] Inventors: T. Thomas Suchodolski, Ware, Mass.; Minglun Qiu, Bloomington, Ind.

[73] Assignee: Otis Elevator Company, Farmington, Conn.

[21] Appl. No.: 62,354

[22] Filed: May 13, 1993

[51] Int. Cl.[5] ..... B66B 9/00

[52] U.S. Cl. ..... 187/1 R; 187/1 A; 187/20

[58] Field of Search ..... 187/1 R, 1 A, 20

[56] References Cited

U.S. PATENT DOCUMENTS

| | | | |
|---|---|---|---|
| 1,907,967 | 5/1933 | Himes | 187/1 R |
| 2,214,139 | 9/1940 | Lindquist | 187/1 A |
| 4,899,852 | 2/1990 | Salmon et al. | 187/1 R |
| 5,074,382 | 12/1991 | Do | 187/1 R |
| 5,129,485 | 7/1992 | Hoch | 187/20 |

FOREIGN PATENT DOCUMENTS

| | | | |
|---|---|---|---|
| 527545 | 1/1977 | Japan | 187/1 R X |
| 5247245 | 4/1977 | Japan | 187/1 R X |
| 54159951 | 12/1979 | Japan | 187/1 R X |

*Primary Examiner*—Robert P. Olszewski
*Assistant Examiner*—Dean A. Reichard

[57] ABSTRACT

The vibrations of an elevator are attenuated between the elevator and a cab by providing an elevator frame disposed in a first plane and a platform in a second plane, the platform being suspended from the frame by a plurality of side braces extending therefrom. A vibration attenuator is disposed directly between each side brace and the platform to attenuate vibrations that may pass between the frame and the platform.

4 Claims, 2 Drawing Sheets fig. 1
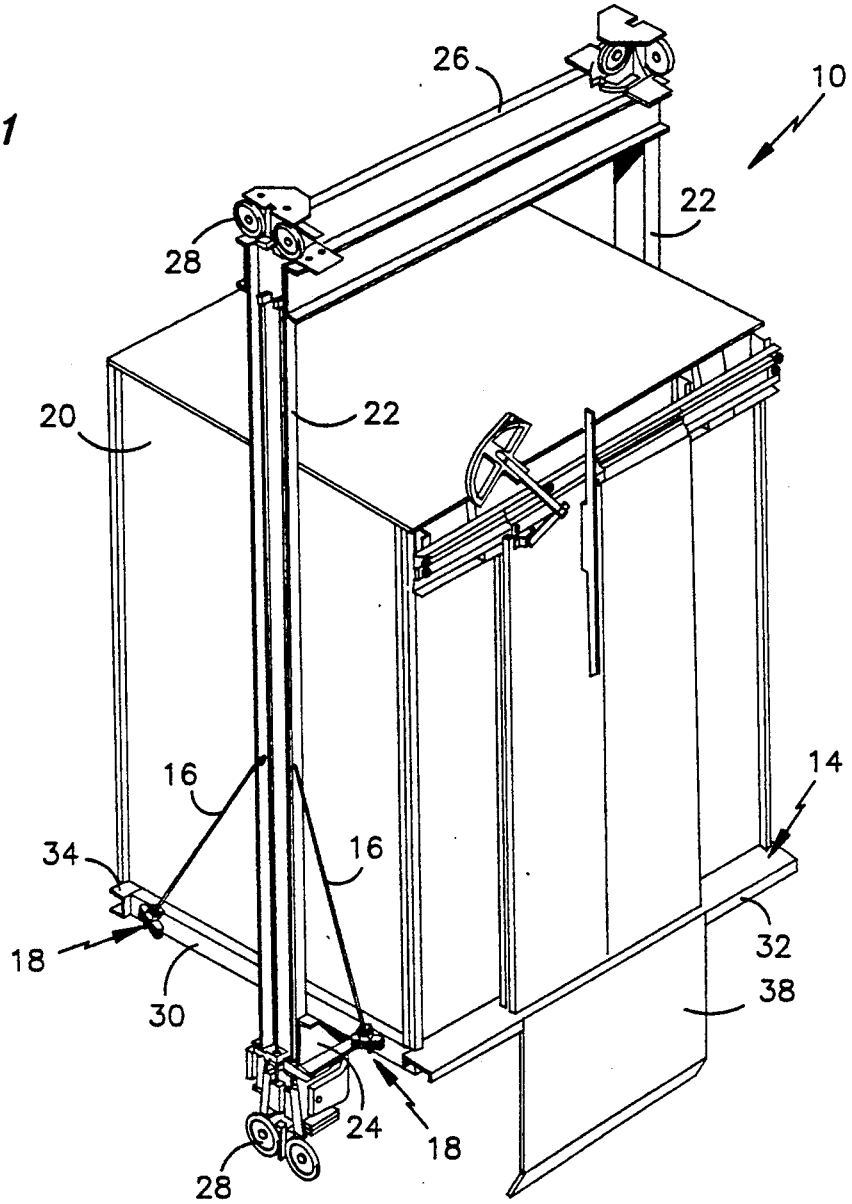
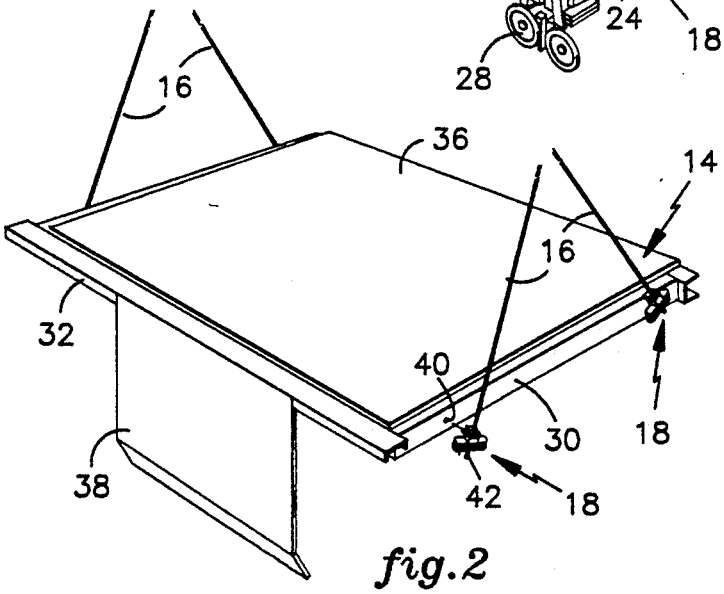
fig. 2

ELEVATOR PLATFORM ISOLATION

DESCRIPTION

1. Technical Field

This invention relates to elevators, and more particularly to an apparatus for isolating elevator platforms from vibration.

2. Background Art

Elevator cabs are typically supported by a vertical and a horizontal frame. The vertical frame supports the horizontal frame and attaches to ropes that raise and lower the frames. A platform is disposed upon the horizontal frame and a cab is disposed upon the platform.

It is desirable in elevator systems to isolate the elevator cab from vibrations propagated by motion of the elevator. Vibrations cause noise and discomfort to passengers traveling within the elevator cab.

In some applications, vibration attenuating devices are disposed between the horizontal frame and the platform. As the car moves, the devices attenuate vibrations which might have been transmitted from the horizontal and vertical frames, via the platform, to the elevator cab.

DISCLOSURE OF INVENTION

It is an object of the invention to attenuate vibrations transmitted from an elevator system to a traveling cab, while minimizing weight, construction and installation costs, and time.

According to the invention, the vibrations of an elevator are attenuated by providing an elevator frame disposed in a first plane and a platform disposed in a second plane, the platform being suspended from the frame by a plurality of side braces extending therefrom. Each side brace is attached to the platform by means of an isolation element which attenuates vibrations which may propagate from the frame to the cab.

According to a feature of the invention, the isolation element is an elastomeric bearing.

According to a feature of the invention, the isolation element is readily replaceable.

By attaching the platform directly to the frame in a different plane, the need for a frame in the plane of the platform is obviated. As a result, the overall cost and weight of the elevator is minimized. By utilizing isolation elements in attaching the platform to the frame, vibrations passing from the frame to the platform and the cab supported thereon are minimized.

The foregoing and other objects, features and advantages of the present invention will become more apparent in light of the following detailed description and accompanying drawings.

BRIEF DESCRIPTION OF THE DRAWINGS

FIG. 1 is a perspective, partially schematic, view of an elevator which utilizes the isolation elements of the invention;

FIG. 2 is a perspective view of the elevator platform of FIG. 1;

BEST MODE FOR CARRYING OUT THE INVENTION

Figure 3:
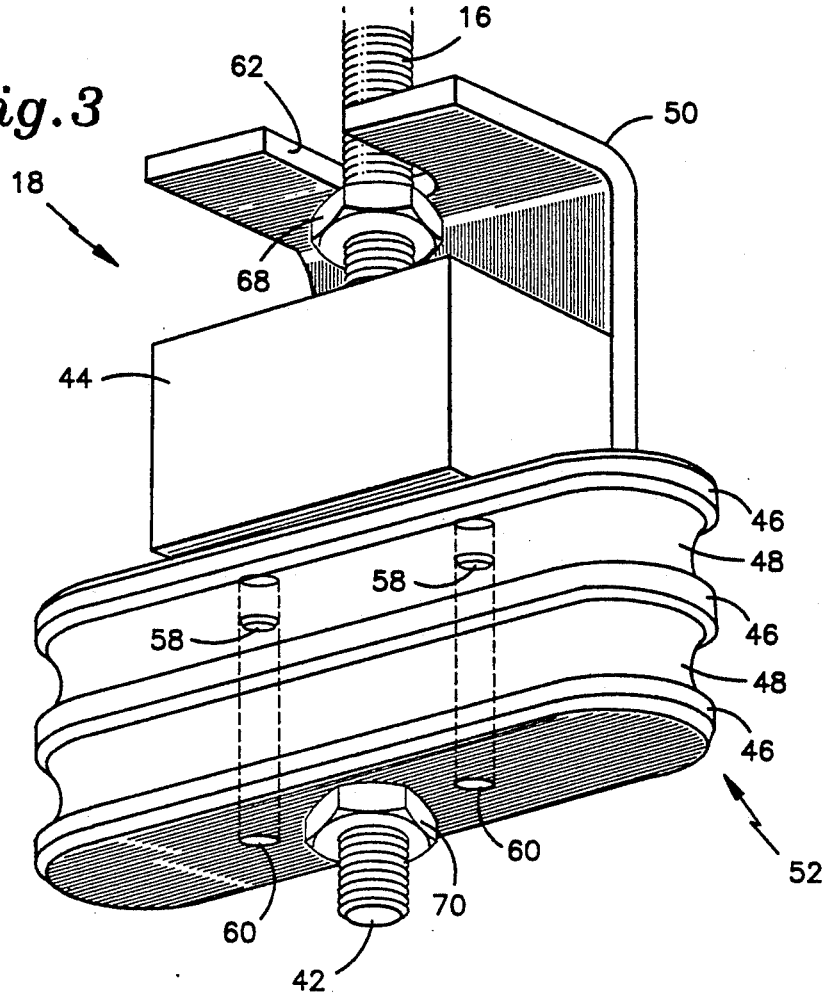
FIG. 3 is a front perspective view of the isolation element of FIG. 2.

Referring to FIG. 1, and elevator 10 incorporating the concepts of the invention is shown. The elevator comprises a frame 12 disposed in a first plane (usually vertical), a platform 14 disposed in a second plane (usually normal to the first plane), a plurality of said braces 16 (see also FIG. 2), a plurality of isolation elements 18 (shown schematically—see also FIG. 2–4) connecting the side braces to the platform, and a cab 20 disposed upon the platform.

As is known in the art, the frame 12 has a pair of stiles 22, a safety plank 24 and a crosshead 26. The stiles are each attached to the safety plank and the crosshead as is known in the art. Each stile has a plurality of rollers 28 mounted thereon for engaging guide rails (not shown) to guide the elevator up and down a hoistway (not shown). The crosshead 26 attaches to ropes (not shown) which raise and lower the frame. The frame is disposed generally within a vertical plane.

The platform 14 is oriented horizontally between the stiles 22, the crosshead 26, and the safety plank 24. The platform has a pair of side beams 30 that are conventionally attached to a front beam 32 and a back beam 34, and a floor 36 disposed upon all four beams. Depending on the weight of the cab, as one of ordinary skill in the art will appreciate, the platform may include a number of reinforcing beams (not shown). The cab 20 rests upon the floor 36. As is known in the art, a toe guard 38 depends downwardly from the floor. The stiles may have holes drilled therethrough as will be discussed infra.

Each side brace 16 is fixedly attached to a stile 22 as is known in the art. Each side brace 16 depends from the frame downwardly at an acute angle towards the platform 14 and attaches by means of a threaded distal end 42 (see FIGS. 2 and 3) to an isolation element 18 as shown in FIG. 2–4, and as will be discussed infra.

Figure 4:
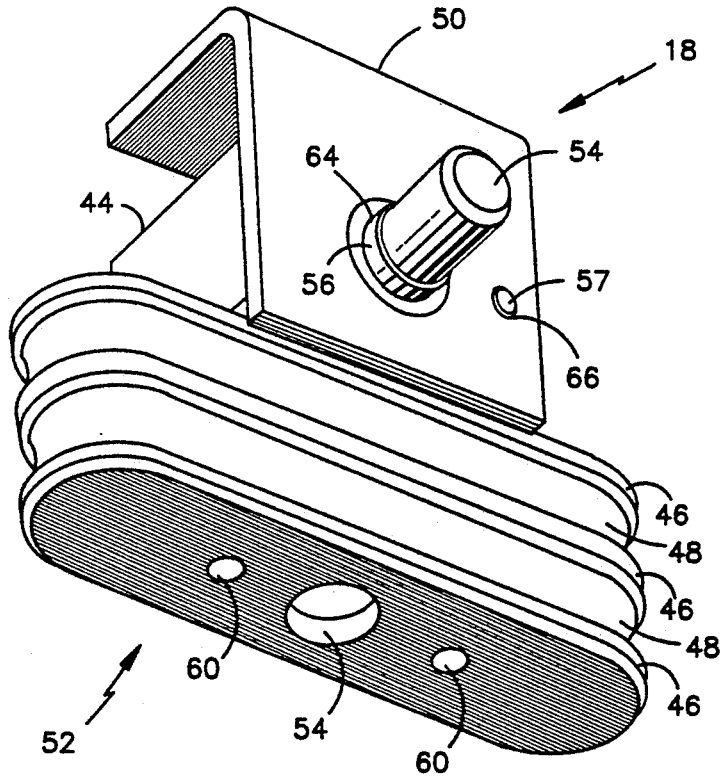
FIG. 4 is a back perspective view of the isolation element of FIG. 2.

Referring to FIGS. 3 and 4, the isolation element 18 is shown in detail. The isolation element comprises a bolt block 44, a plurality of metallic plates 46, a vibration isolation material 48, such as an elastomer, disposed between the connecting adjacent plates 46. One of ordinary skill in the art will recognize that the plates and the isolation material form an elastomeric bearing 52.

The bolt block 44 is rectangularly shaped and has; a threaded shear pin 54 extending therefrom; a circular boss 56 and a first locating pin 57 (see FIG. 4) for cooperating with the jack plate 50 as will be discussed infra; and a pair of second locating pins 58 for cooperating with the elastomeric bearing. The bolt block rests upon the elastomeric bearing 52.

The material 48, the bolt block 44, and the plates 46 each have a first opening 54 (see FIG. 4) extending therethrough for receiving a side brace 16. The diameter of the opening 54 in the plates 46 is greater than the diameter of a side brace to minimize interference therebetween. The diameter of the opening 54 in the material is slightly smaller than the side brace to minimize contact between the side brace and the plates. The material 48, and the plates 46 each have a pair of second openings 60 extending therethrough. Second locating pins 58 only extend into openings 60 a short distance (through one plate 46) to maximize the effectiveness of the elastomeric bearing. The second locating pins prevent the elastomeric bearing from turning relative to the bolt block.

The jack plate is an angle iron having a slot 62 (see FIG. 3), a third opening 64 for receiving the boss 56, and a fourth opening 66 for receiving a first locating pin. The first locating pin prevents the jack plate from turning relative to the bolt block. The slot does not touch the side brace.

To assemble the platform, the boss 56 and the first locating pin of the bolt block extend through third opening 64 and the fourth opening 66 of the jack plate, respectively. The second locating pins 58 of the bolt block are inserted in the second openings 60 in the elastomeric bearing. The side braces 16 are attached to the stiles by conventional means, threaded through a jack nut 68 disposed between the slot 62 and the bolt block 44 and the hole 54, and secured to the elastomeric bearing 52 by placing a nut 70 upon the threaded distal end 42 of each side brace. Each shear pin 54 is threaded through hole 40 in the side beam and secured thereto by means of a nut (not shown).

If the elastomeric bearing wears out or is need of repair, the jack nut 68 is rotated upwardly until it contacts the jack plate 50. The nut 70 can be removed as the jack plate, through its connection to the boss and the shear screw, now bears the weight of the platform and cab. Once the nut 70 is removed, the elastomeric bearing slides off the second locating pins 58 and the side brace and a new elastomeric bearing is put in its place. The nut 70 is then replaced and the jack nut 68 is rotated downwardly out of contact with the jack plate to place the weight of the platform and cab back on the new elastomeric bearing for further vibration attenuation.

By placing an elastomeric bearing between the side braces and the platform, the platform and the cab disposed thereupon are effectively isolated from the vibrations in the moving frame and side braces. By attaching the side braces directly to the platform, the need for a horizontal supporting frame is eliminated along with the costs and time of constructing and installing such a frame and the cost of the frame's weight. By utilizing a readily replaceable elastomeric bearing, the cost of replacing worn or damaged elastomeric bearings is minimized.

Although the invention has been shown and described with respect to a best mode embodiment thereof, it should be understood by those skilled in the art that various other changes, omissions and additions in the form and detail thereof may be made therein without departing from the spirit and scope of the invention.

We claim:

1. An apparatus for supporting an elevator cab, said apparatus comprising:

a frame disposed in a first plane;

a platform for supporting said cab, said platform being disposed in a second plane;

a plurality of braces having a first end portion attaching to said frame and a second end portion extending from said frame;

a means for attenuating vibrations within said frame, said means attaching directly between said second end portion of said braces and said platform whereby said means isolates said platform from vibrations in said frame; and means for replacing said means for attenuating vibrations without disconnecting said braces from said platform.

2. Apparatus of claim 1, wherein said means for replacing comprises:

a jack nut attached to each of said braces, and means for bearing a weight of said platform if in contact with said jack nut.

3. Apparatus for supporting a cab, said apparatus comprising:

a frame disposed in a first plane;

a platform for supporting said cab, said platform being disposed in a second plane;

a plurality of braces having a first end portion attaching to said frame and a second end portion extending from said frame;

means for attenuating vibrations within said frame, said means attaching directly between said second end portion of said braces and said platform whereby said means isolates said platform from vibrations in said frame; and means for replacing said means for attenuating vibrations without disconnecting said braces from said platform.

4. Apparatus of claim 3, wherein said means for replacing comprises:

a jack nut attached to each of said braces; and means for bearing a weight of said platform if in contact with said jack nut.

* * * * *